US006134849A

United States Patent [19]

Holler

[11] Patent Number: 6,134,849

[45] Date of Patent: Oct. 24, 2000

[54] PREFABRICATED SELF-SUPPORTING PANELLED STRUCTURE SYSTEM

[76] Inventor: Max Michael Holler, 28076 Cavendish Ct., #2107, Bonita Springs, Fla. 34135

[21] Appl. No.: 09/298,765

[22] Filed: Apr. 23, 1999

[51] Int. Cl.[7] ..... E04B 1/32; E04B 1/342

[52] U.S. Cl. ..... 52/80.1; 52/80.2; 52/81.1; 52/81.3; 52/81.4; 52/648.1

[58] Field of Search ..... 52/80.1, 80.2, 52/81.1, 81.2, 81.3, 81.4, 81.5, 648.1, DIG. 10

[56] References Cited

U.S. PATENT DOCUMENTS

| | | | |
|---|---|---|---|
| 2,918,992 | 12/1959 | Gelsavage | 52/81.1 |
| 3,026,651 | 3/1962 | Richter | 52/81.4 |
| 4,009,543 | 3/1977 | Smrt | 52/81 |
| 4,160,345 | 7/1979 | Nalick | 52/81 |
| 5,377,460 | 1/1995 | Hicks | 52/81.1 |
| 5,732,514 | 3/1998 | Organ | 52/81.1 |
| 5,937,589 | 8/1999 | Fischer | 52/81.3 |

*Primary Examiner*—Christopher T. Kent
*Assistant Examiner*—Jennifer I. Thissell

[57] ABSTRACT

A number of triangular or rectilinear flat panels are bent along their edges forming flanges. The so-formed panels are fastened together at the flanges, reinforced at the junctures of the flanges, producing a dome-like structure. This differs from other structures that are usually composed of a skeleton of ribs, covered separately by flat or curved panels or fabric sheets.

9 Claims, 8 Drawing Sheets

PREFABRICATED SELF-SUPPORTING PANELLED STRUCTURE SYSTEM

BACKGROUND OF THE INVENTION

1. Field of the Invention

This invention is directed to a system for making and erecting prefabricated, self-supporting panelled structures, and in particular to a monocoque building system and its buildings.

2. Prior Art

The use of prefabrication systems is relatively modern, including Nissen huts, which were made from curved corrugated iron sheets, and widely used in World War II.

Prefabricated structures have also been used for ships, aircraft hangar structures and for other purposes. In the aircraft industry, some airplane fuselages have been of monocoque construction, where the skin of the fuselage is itself load-bearing.

Geodesic structures such as geodesic domes made famous by Buckminster Fuller consist of a space framework, usually composed of triangular form units, having a covering such as a diaphragm over its exterior surface.

SUMMARY OF THE INVENTION

The present invention provides a construction system wherein a multiplicity of shaped panels having inclined flange portions extending from their respective sides are secured in adjoining, mutually relation, wherein the adjoined flange portions serve as the integral ribs for the structure.

In the case of a domed structure, the panels are shaped and progressively sized such that when joined together by their adjoining flange portions, the desired dome shape is achieved.

Panels of substantially rectangular and triangular form lend themselves to such forms of structure.

It will be understood that while structural rigidity is greatly facilitated by the form of the building or structure, use can be made of the present system to provide structures having planar surfaces formed by the assembly of a plurality of the panels. Conversely, while economical use is made of planar sheeting material for the panels, curved or even spherically formed sheet or plate may be used for that purpose.

Certain embodiments of the present invention utilize panels in assembled relation, having the panel flanges located in the interior of the structure. However, the reverse arrangement can also be used, wherein the geometry of the panels enable their assembly with the flanges located exteriorly of the structure. Such an arrangement facilitates assembly of the structure, to ameliorate the labor-intensive assembly aspect of the system, and the exterior location of the ribs lends itself to the application and retention of foamed insulation and a sealing diaphragm over the structure exterior.

Structures in accordance with the system have readily met national and local building codes.

The arrangement of the adjoining panels facilitates the use of local reinforcement at the panel corner junctures. Such reinforcement may be readily applied both internally and/or externally.

In addition to the provision of reinforcement at the panel junctures, further reinforcement may be provided by way of rib plates secured in a sandwiched relation between adjoining panel flanges. Such plates may protude beyond the panel flanges, to serve as hangar attachements for interior partition walls, ceiling beams or the like.

The form of the flanges of the panels may be planar, or of "L" or "C" section, to provide greater structural strength and stiffness.

Fastening together of the panel flanges may utilize bolts, self-tapping tap screws, rivets, welding, such as spot-welds, or interlocking piercing by methods such as "TOG-L-LOC" (T.M.) or "LANCE-N-LOC" (T.M.), well-known in the metal working trades, where the material of the flanges is pierced in interpenetrating, mutually locking relation.

Panel material such as stainless steel can be readily and accurately cut by numerical-controlled laser cutting equipment, while avoiding distortion of the panels.

In a specific embodiment a storage building of some 22 meters diameter was constructed in accordance with the invention from 45 mil(0.045 inch) laser-cut stainless steel.

BRIEF DESCRIPTION OF THE DRAWINGS

Certain embodiments of the invention are described by way of illustration, without limitation thereto other than as set forth in the accompanying claims, reference being made to the accompanying drawings, wherin:

DETAILED DESCRIPTION OF THE INVENTION

Figure 1:
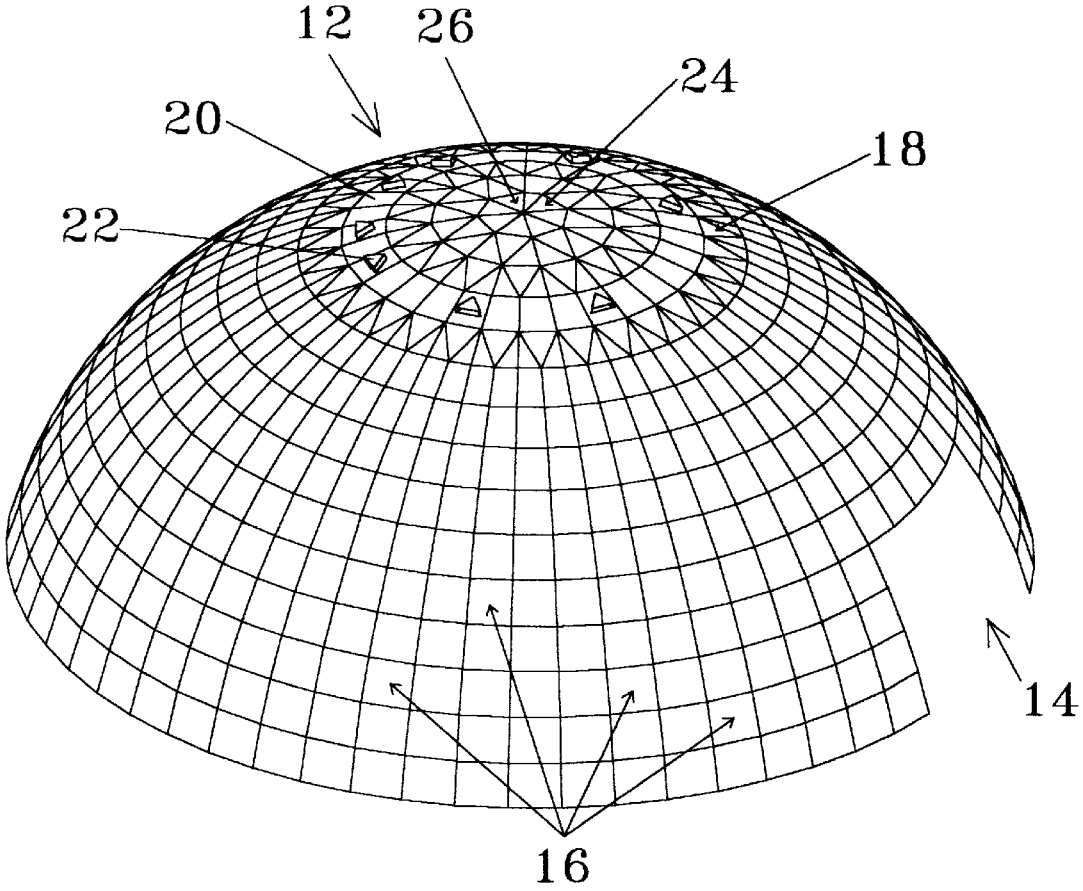
FIG. 1 is a perspective view, taken from above, of a self-supporting monocoque building structure fabricated of rectangular and triangular flanged panels in accordance with the present invention.

Referring to FIG. 1, a domed structure 12 having a portal 14 is illustrated as being made up of several lower courses (rows) of substantiially rectangular panels 16, the taper of which determines the form of the profile of the structure 12, i.e. the radius of curvature of the near-hemisperical dome 12.

An intermediate course of triangular panels 18 is followed by one course of four-sided tapered panels 20, which include ventilator covers 22. The crown 24 of the structure 12 comprises a circular arrangement of triangular panels 26.

Figure 2:
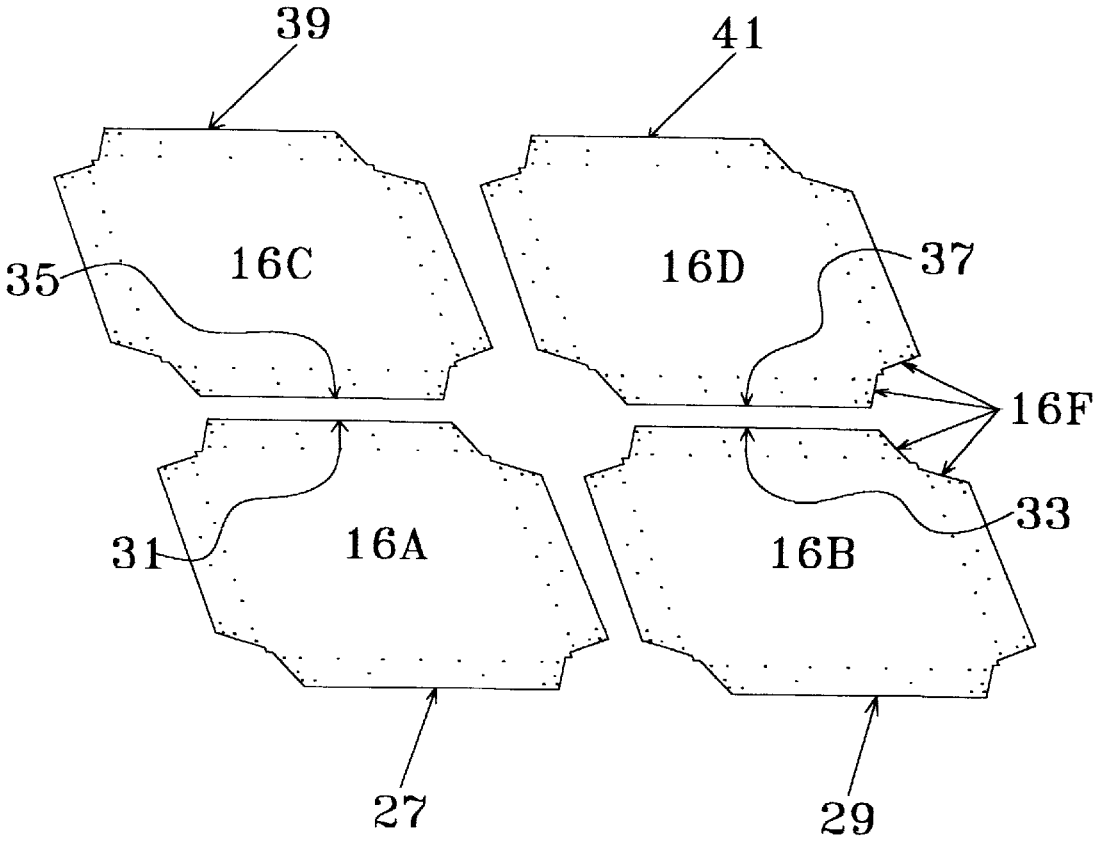
FIG. 2 is a like perspective view of four adjoining panel blanks of substantially rectangular shape.
Figure 3:
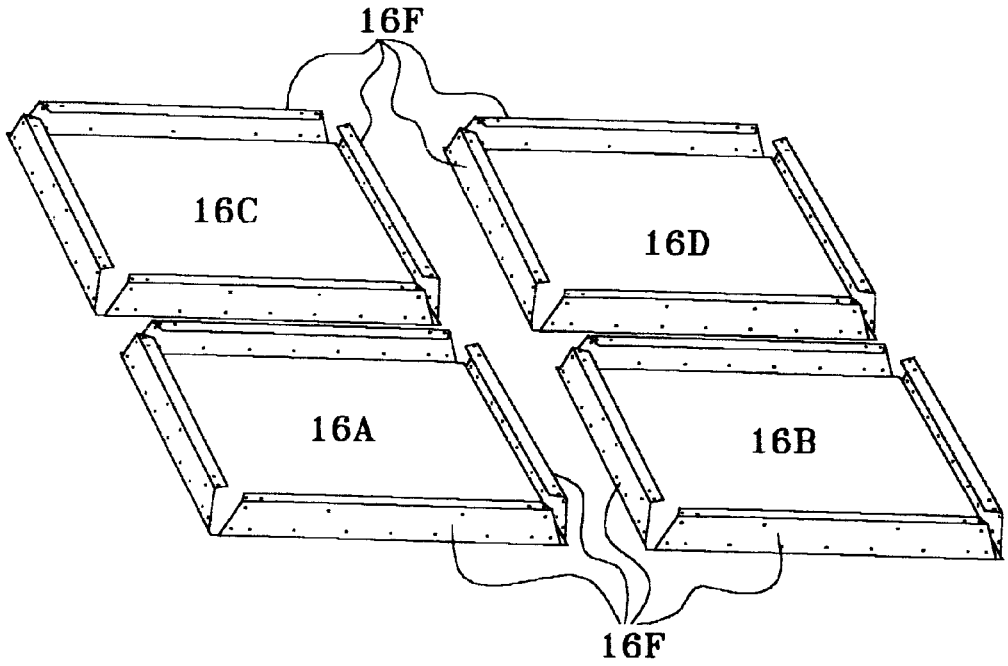
FIG. 3 is a like perspective view of of the panel of FIG. 2, with the side flanges formed.
Figure 4:
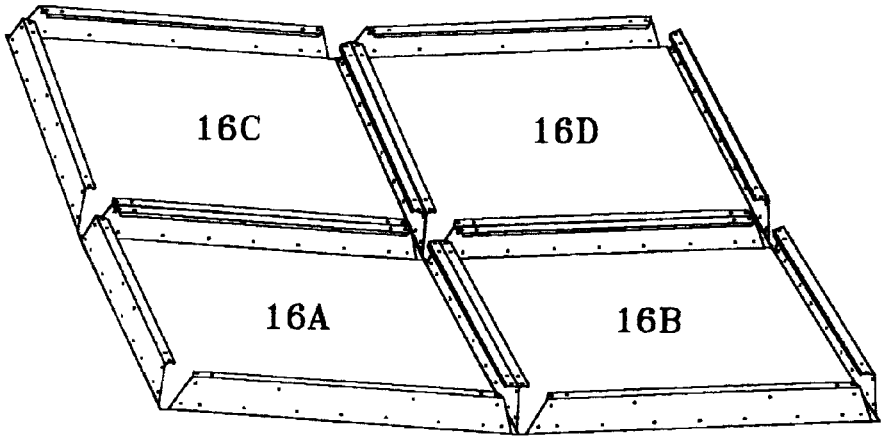
FIG. 4 is a like perspective view of the FIG. 3 panels in assembled relation.

Referring to FIGS. 2,3 and 4, four of the lower panels 16 are illustrated as being substantially square. The Panels 16A, 16B are from the same panel course, being idiential.

Their lower edges 27, 29 are slightly longer than their upper edges 31,33, thus providing the taper required for the structure profile form. The panels 16C, 16D have a lower edge 35, 37 the same length as the adjacent edges 31, 33; their upper edges 39, 41 are shorter than the lower edges 35, 37, to provide the desired structure profile form.

The corner of each panel 16A, 16B, 16C and 16D is cut out, to form side flange portions 16F. In practice, in one embodiment, the plane flanges 16F were made 5 inches wide. In instances where the panel flange portions are formed into L or C profiles, the flange portion corresponding to 16F is made accordingly deeper. The location of the panel fasteners on the flange portions 16F are indicated, and may be drilled in some instances, but are usually cut by numerically-controlled laser cutting equipment.

FIG. 3 shows the panel flange portions 16F after being bent upwards in a forming press. The panel flange portions 16F are slightly inclined, inwardly, as a function of the form-taper by which the structure is shaped.

FIG. 4 shows the four panels 16A–D assembled into their final formation, the fasteners being omitted. The curvature effect provided by the planar panels 16 is clearly evident.

Referring to the embodiments of FIGS. 5 through 8, FIG. 5 illustrates five courses of triangular panels 50, being a portion of an actual domed structure embodiment.

Figure 5:
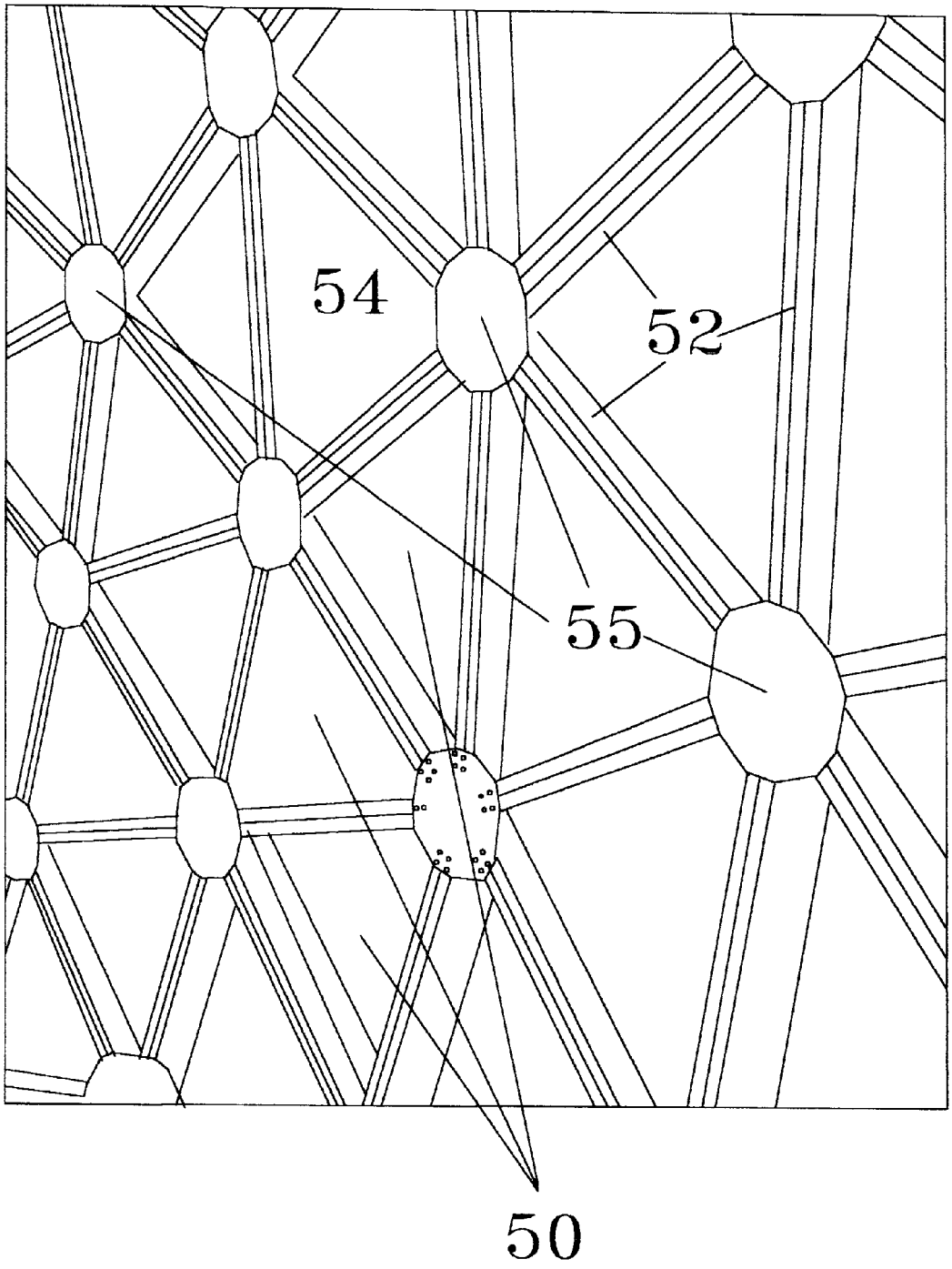
FIG. 5 is a schematic interior view, in elevation, of a portion of a wall construction comprising a second embodiment of the present invention, having triangular panels with L-section flanges.
Figure 6:
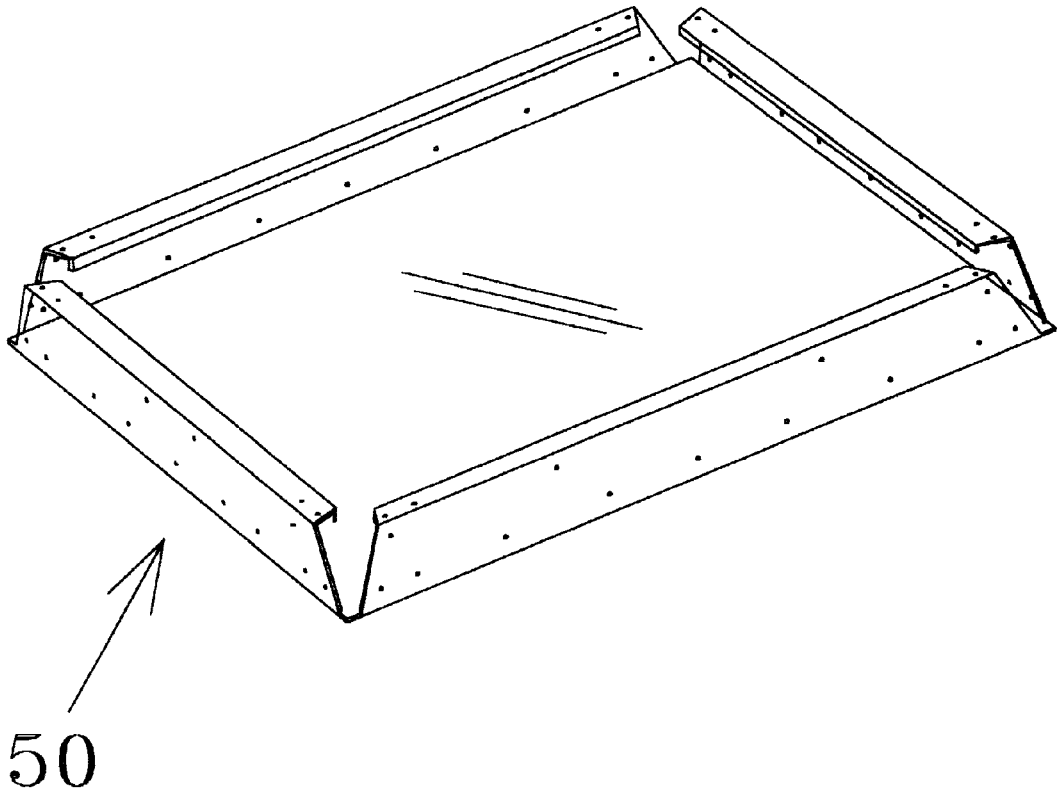
FIG. 6 is a perspective view of a rectangular panel of the FIG. 4 assembly.
Figure 7:
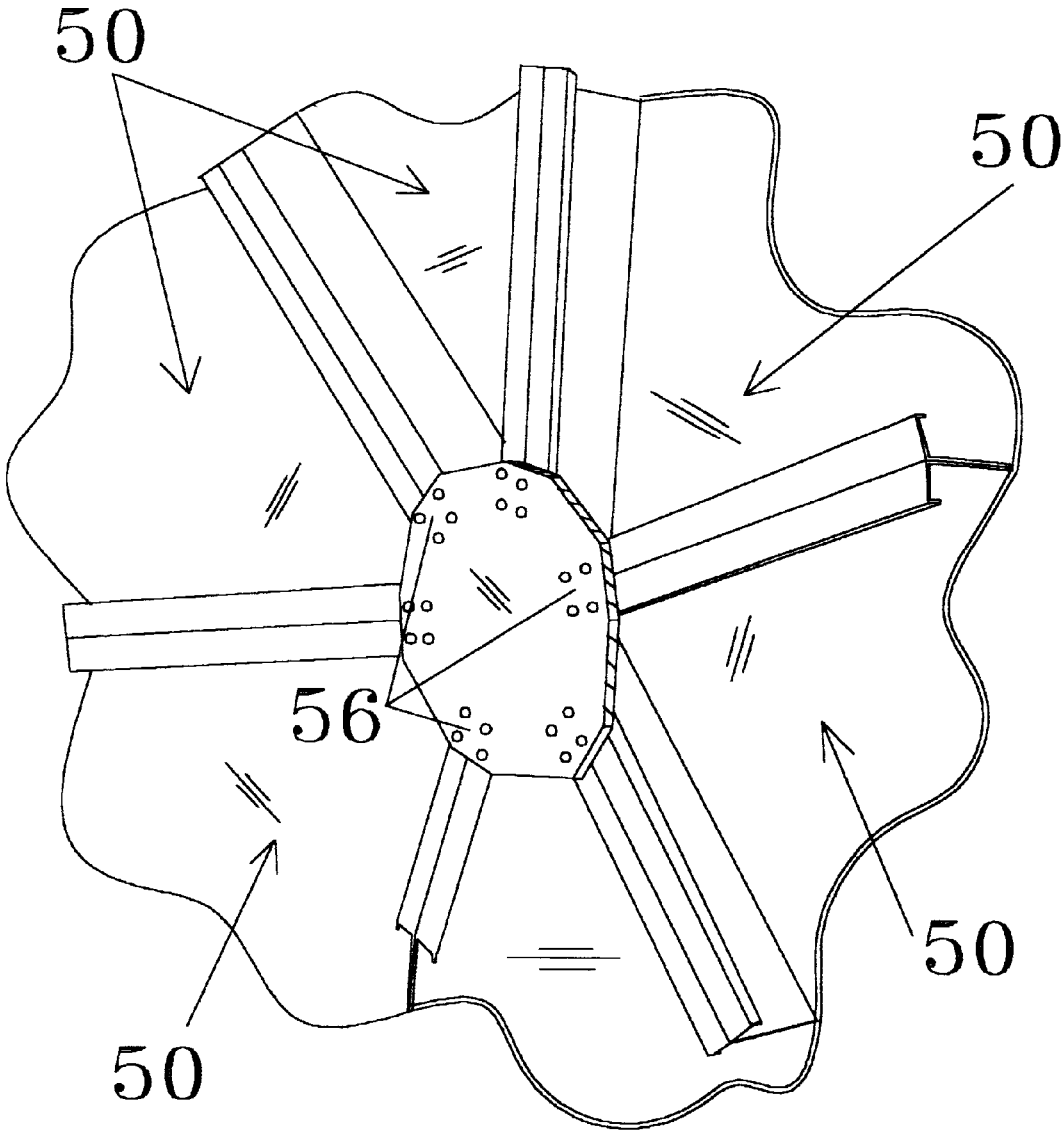
FIG. 7 is an enlarged, interior view of a portion of the FIG. 1 construction.
Figure 8:
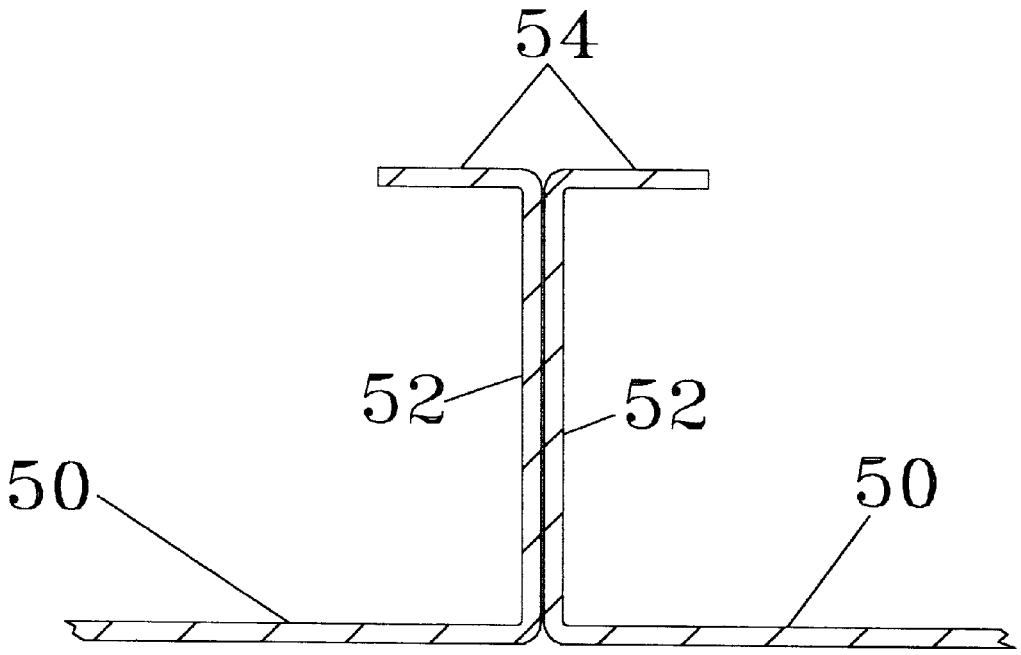
FIGS. 8 and 9 show end views of panel flange embodiments.

The panels 50 have L-section side flanges 52 of some 5-inches width, the panels having sides some three feet in length. The side flanges 52 have top ribs 54 of about one inch width. The flanges 52 of the adjoining panels 50 are bolted in back-to-back relation. Some of the capscrew locations are indicated in FIG. 5.

It will be understood that all abutting panel flanges are thus secured to each other in mutual, rib-forming, stiffening relation. Reinforcement plates 55 are bolted to the junctures of the panels 50, tying their flanges 52 together, by way of the ribs 54, to which the capscrews 56 are secured. As indicated above, alternative fastening methods may be used, including piercing, riveting, spot welding etc.

Figure 9:
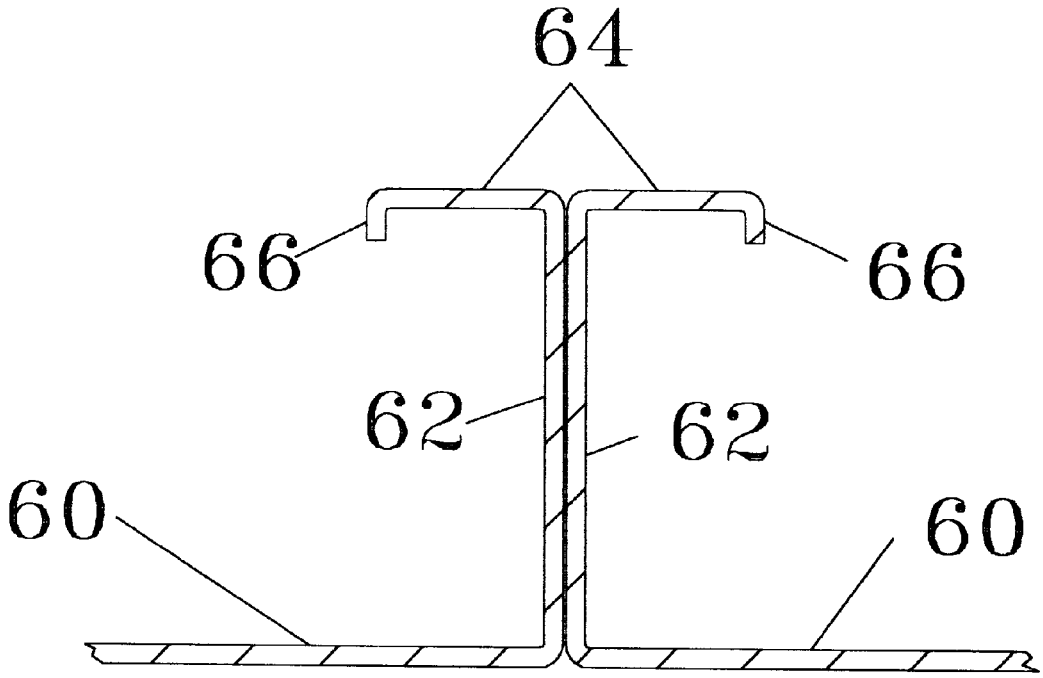

FIG. 9 shows an end view of the flange portions of a pair of adjoining panels 60 having side flanges 62, and ribs 64, with stiffener lips 66.

What is claimed is:

1. A structure having a multiplicity of shaped monolithic panels, each of said monolithic panels having a major surface portion bounded by at least three rectilinear sides, each side having an integral flange portion extending therefrom at an angle substantially normal to the plane of said panel; said panels being arranged with respective adjoining ones of said flange portions in mutually abutting, secured relation, the adjoined flange portions serving as integral structural ribs for the structure wherein at least two said flange portions each consists of a side flange portion, and a rib portion having a stiffening lip extending substantially at rightangles to said rib portion.

2. The structure as set forth in claim 1, said panels forming a self-supporting substantially enclosed domed structure.

3. The structure as set forth in claim 2, wherein a plurality of said panels have four sides, each said side flange portion having said rib portion with said stiffening lip, the panels being shaped and progressively sized such that when joined together by their adjoining said flange portions, a desired dome shaped structure is achieved.

4. The structure as set forth in claim 2, wherein a plurality of said panels have three sides, each said flange portion having said rib portion with said stiffening lips.

5. The structure as set forth in claim 1, including reinforcement plates, each consisting of a unitary, substantially planar plate member, located at the junctures of said adjoining panels, being secured in overlapping, secured relation to said flange rib portions, to significantly enhance the strength of said structure.

6. The structure as set forth in claim 3, including reinforcement plates, each consisting, of a unitary, substantially planar plate member, located at the junctures of said adjoining panels, being secured in overlapping, secured relation to said flange rib portions, to significantly enhance the strength of said structure.

7. The structure as set forth in claim 4 including substantially planar reinforcement plates located at the junctures of said adjoining panels, being secured in overlapping relation to said flange rib portions, to significantly enhance the strength of said structure.

8. The method of making a self-supporting structural shell, consisting of the steps of fabricating a plurality of monolithic flanged panels of predetermined shape and size, including cutting panels to a predetermined oversize from sheet material; bending edge portions of said cut panels in a break, to form a flange having a rib portion with a stiffening lip; assembling the panels in side by side adjoining relation, having the respective flanges of said panels in mutual abutting relation, and securing said flanges together whereby said secured flanges form structural rib portions of said shell.

9. The method as set forth in claim 8, including fabricating planar reinforcement plates to cover respective juncture areas of said abutting flanges, and securing said reinforcement plates to said rib portions of said panels in tying, reinforcing relation therewith.

* * * * *